United States Patent [19]

Takahashi et al.

[11] 4,339,293

[45] Jul. 13, 1982

[54] PROCESS AND MACHINE FOR DISPOSING OF STICKY SHEET

[75] Inventors: Yasuhiro Takahashi, Tokyo; Yoshiharu Ohinata, Toride; Matsuo Nakamura, Tokyo, all of Japan

[73] Assignee: Riso Kagaku Corporation, Tokyo, Japan

[21] Appl. No.: 227,257

[22] Filed: Jan. 22, 1981

[30] Foreign Application Priority Data

Feb. 15, 1980 [JP] Japan ..... 55/17391

[51] Int. Cl.[3] ..... B31F 1/34

[52] U.S. Cl. ..... 156/227; 101/114; 156/204; 156/474; 270/39; 493/411; 493/413

[58] Field of Search ..... 156/204, 226, 227, 474, 156/344, 584; 19/163; 270/30, 39; 493/411, 413, 446, 419–420; 101/116, 118, 114; 100/80, 81; 53/429, 116, 117

[56] References Cited

U.S. PATENT DOCUMENTS 2,495,994 1/1950 Ward et al. ..... 270/39 X
3,222,730 12/1965 Kalwaites ..... 19/163 X
3,805,474 4/1974 Gerstein ..... 53/429
3,868,809 3/1975 Bledsoe ..... 100/80 X

*Primary Examiner*—David A. Simmons
*Attorney, Agent, or Firm*—Birch, Stewart, Kolasch & Birch

[57] ABSTRACT

A sticky sheet which is to be disposed of is fed in a first direction parallel to its surface so that its leading edge abuts against a stopper construction. The sticky sheet is then further fed in the first direction and is folded up in a second direction substantially perpendicular to the first direction into several layers against the stopper construction, these layers resting upon a plane support construction which extends from the lower part of the stopper construction in the direction opposite to the first direction. Then the superposed layers of the folded sticky sheet are moved in a third direction substantially perpendicular to the first and second directions while being compressed together so as to stick them together so as to be disposed of in the form of a relatively thick and narrow strip including several superposed layers which are adhering together due to their stickiness. A machine is also disclosed for disposing of a sticky sheet in the above described way.

9 Claims, 9 Drawing Figures

PROCESS AND MACHINE FOR DISPOSING OF STICKY SHEET

BACKGROUND OF THE INVENTION

The present invention relates to a method and to a machine for disposing of a sticky sheet. More particularly, the present invention relates to a method and a machine for disposing of a used stencil sheet which has been used for stencil printing and which is sticky with stencil printing ink.

Various rotary stencil printing devices are presently known in the art. In a typical such rotary stencil printing device a stencil master, which is of the form of a flat sheet pierced with apertures whose shapes define characters, figures, etc. which it is desired to reproduce, is fixed around the cylindrical outer periphery of a printing drum. Ink is supplied from within the printing drum through holes or the like in the outer peripheral surface thereof to the radially inner side of the stencil master, and this ink passes through the above apertures to the radially outer side of the stencil master. The printing drum is rotated, and paper or the like on which it is required to form printed impressions is brought into contact with the radially outer surface of the stencil master fixed around the periphery of the rotating printing drum. Accordingly, printed copies are produced in as many numbers as desired.

In such a conventional rotary stencil printing device, after printing from a particular stencil master sheet has been completed, it is of course required to remove the stencil sheet from the printing drum, and it is subsequently necessary to dispose of the used stencil sheet, which at this time is moist and sticky with the remnants of the ink which has been used for printing. Conventionally, both the removal operation for the used stencil sheet, and the disposal operation thereof, have been carried out by hand by the operator of the rotary stencil printing device, but this is an unsatisfactory method. Both of these operations are troublesome and time consuming, and the used stencil sheet which is sticky with printing ink is extremely messy, and accordingly there is a great danger that a human operator performing these operations by hand will become soiled with the printing ink; it is also quite likely that the clothes of the operator will become dirty with the printing ink.

With regard to the operation of peeling off the used stencil sheet from the outer cylindrical peripheral surface of the printing drum, a desirable and convenient means for doing this is for one edge of the stencil sheet which extends along the direction of the generatrices of the printing drum to be first removed from the surface of the printing drum, and then for this edge of the stencil sheet, perhaps via a lug or the like provided thereon, to be pulled in the direction away from the printing drum along a line which is tangential to the surface of the printing drum, while the printing drum is rotated in an appropriate direction. In this way, the stencil sheet is progressively unwrapped from around the outer periphery of the printing drum, against the sticky and viscous effect provided by the printing ink which is present between the stencil sheet and the printing drum. A technique for performing this operation automatically has been proposed in Japanese Utility Model Application No. 179596 which was filed on Dec. 24, 1979 in the Japanese Patent Office, by Riso Kagaku Corporation.

With regard to the operation of disposal of the sticky stencil sheet after it has been peeled away from the outer periphery of the printing drum, prior art techniques for doing this, which have involved manual intervention by the operator of the machine, have been very unsatisfactory. It takes quite a long time to dispose of such a sticky stencil sheet by hand, especially if the operation is to be performed cleanly, without soiling the operator. Further, if the used sticky stencil sheet is discarded, in the form in which it has been removed from the rotary printing drum, into a wastepaper basket, special purpose disposal box, or disposal bag, then, because the used stencil sheet is considerably bulky, the box or bag quickly becomes full. On the other hand, crumpling up or folding the sticky stencil sheet into a compact form while it is sticky with printing ink, by hand, is a very unattractive procedure for the operator of the machine, and will inevitably soil the operator. In practice, therefore, according to prior art disposal methods, the box or bag which is being used for disposal of sticky used stencil sheets quickly becomes full, and this presents the problem that inevitably frequent cleaning or exchange of this box or bag will be required.

SUMMARY OF THE INVENTION

Therefore, it is an object of the present invention to provide a process for disposing of a sticky sheet which may be performed automatically, and to provide a machine for automatically disposing of a sticky sheet.

It is a further object of the present invention to provide a process for disposing of a sticky sheet, and a machine for disposing of a sticky sheet, in which the disposal of the sticky sheet is accomplished in a quicker way than has been possible in the prior art.

It is a further object of the present invention to provide a process for disposing of a sticky sheet, and a machine for disposing of a sticky sheet, in which the disposal of the sticky sheet is accomplished in a clean fashion, without there being any danger of soiling an operator, or the clothes of an operator.

It is a further object of the present invention to provide a process for disposing of a sticky sheet, and a machine for disposing of a sticky sheet, in which the disposal of the sticky sheet is accomplished in a form which is more compact than has heretofore been possible.

It is a further object of the present invention to provide a process for disposing of a sticky sheet, and a machine for disposing of a sticky sheet, in which the disposal of the sticky sheet is accomplished in a less sticky form than has heretofore been possible.

It is a further object of the present invention to provide a process for disposing of a sticky sheet, and a machine for disposing of a sticky sheet, in which the disposal of the sticky sheet is accomplished in a folded up form.

It is a further object of the present invention to provide a process for disposing of a sticky sheet, and a machine for disposing of a sticky sheet, in which the disposal of the sticky sheet is accomplished in a way particularly adapted to the disposal of a sticky sheet which is composed of a stiff edge portion and a less stiff body portion bordered by said stiff edge portion.

According to the present invention these and other objects are accomplished by: (I) a process for disposing of a sticky sheet, comprising the steps of: (a) feeding said sticky sheet in a first direction substantially parallel to its surface so that the leading edge of said sticky sheet in said first direction is abutted against a stopper construction; subsequently( (b) further feeding said sticky sheet in said first direction so that said sticky sheet is folded up into a plurality of layers superposed in a second direction substantially perpendicular to the surface of said sticky sheet during the abovementioned feeding step, said layers then resting upon a support construction which extends from the lower part of said stopper construction in the direction opposite to said first direction; and subsequently (c) moving said sticky sheet in a third direction substantially perpendicular to said first and second directions so as to dispose of said sticky sheet, while compressing together said superposed layers in said second direction so as to stick together said superposed layers; and by (II) a machine for disposing of a sticky sheet, comprising: (a) a means for feeding said sticky sheet in a first direction substantially parallel to the surface of said sticky sheet; (b) a stopper construction, located in a position so that the leading edge of said sticky sheet, as said sticky sheet is moved in said first direction by said feeding means, is abutted against said stopper construction and is stopped thereby; (c) a plane support construction, which extends from the lower part of said stopper construction in the direction opposite to said first direction, so that, as said sticky sheet is further fed in said first direction by said feeding means after the leading edge of said sticky sheet has abutted against said stopper construction, said sticky sheet is folded up into a plurality of layers superposed on one another in a second direction substantially perpendicular to the surface of said plane support construction while said sticky sheet is being fed by said feeding means, said superposed layers resting on said support construction; and (d) a means for moving said sticky sheet, which, after said sticky sheet has been folded into said plurality of superposed layers resting on said plane support construction, moves said sticky sheet in a third direction substantially perpendicular to said first and second directions so as to dispose of said sticky sheet, while it compresses together said superposed layers in said second direction so as to stick together said superposed layers.

According to such a process for disposing of a sticky sheet and according to such a construction for a machine for disposing of a sticky sheet, the sticky sheet may be conveniently automatically disposed of. Further, this disposal may be performed in such a fashion that completely obviates the chances of soiling the operator. Also, because the sticky sheet is disposed of in a much more compact form, the effective capacity of a receptacle such as a box, a bag, or a basket for disposal of said sticky sheets becomes much greater. Since the disposal form for the sticky sheet is as a matter of course a less sticky form, thereby the messiness of the sticky sheets which are being disposed of is reduced. This is enhanced by the fact that the sticky sheets are being disposed of in a folded up form.

According to a particular aspect of the present invention, the compression together of said superposed layers of said sticky sheet may be a rolling together which is performed by passing said superposed layers between a first roller and a second roller parallel to said first roller, and by crushing said superposed layers between said first and said second rollers, also for the purpose of moving said superposed layers of said sticky sheet sideways in said third direction.

BRIEF DESCRIPTION OF THE DRAWINGS

The present invention will now be described in terms of a particular embodiment thereof, and with respect to the appended drawings. However, it should be clearly understood by all those whom it may concern that neither the description of the embodiment, nor the drawings, are intended to be limitative of the scope of the present invention, which is in fact to be defined solely by the appended claims. In the drawings:

DESCRIPTION OF THE PREFERRED EMBODIMENT

The present invention will now be described in terms of a preferred embodiment thereof, and with reference to the accompanying drawings.

Figure 1:
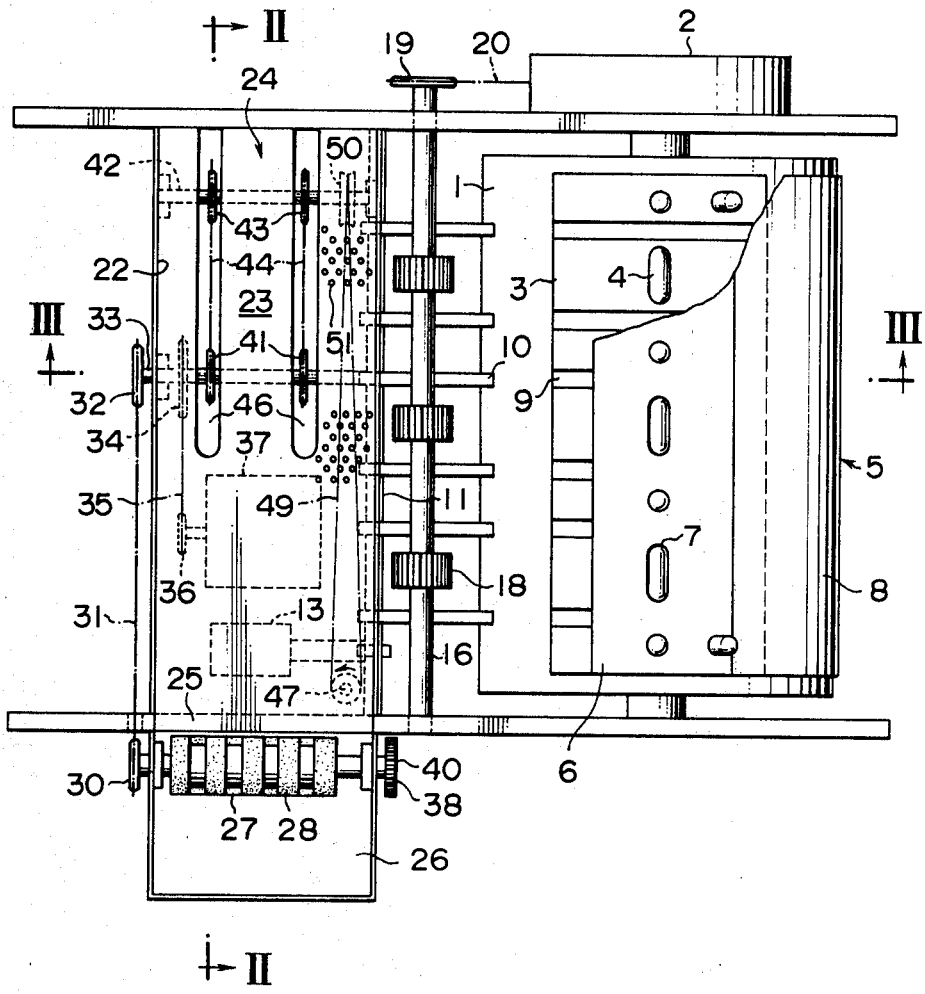
FIG. 1 is an explanatory plan view of essential parts of a preferred embodiment of the machine according to the present invention for disposing of a sticky sheet, which according to the function of this embodiment is a used stencil sheet which has been used for stencil printing with sticky ink, said preferred embodiment of the present invention being incorporated in a rotary stencil printing device of which the rotary printing drum and other parts are also shown.

In FIG. 1 a general plan view of a machine which is a preferred embodiment of the machine according to the present invention, is shown, along with other parts of a rotary stencil printing device. In this figure, the reference numeral 1 denotes a rotary stencil printing drum, which is in the general form of a right circular cylinder, and which is rotatably mounted about its central axis and is adapted to be selectively rotated through appropriate rotational amounts by a driving system 2. A stencil sheet fixing member 3 is mounted on and extends longitudinally along a part of the outer cylindrical surface of the rotary stencil printing drum 1, as may be best seen in FIG. 3, which shows a cross section of the rotary printing drum 1, and from this stencil sheet fixing member 3 there extend outwards in the radial direction of the printing drum 1 a plurality of sheet fixing projections 4, some of which, in fact, in this embodiment, are formed as inversely U-shaped projections, while some are formed as circular pins. Further, along the outer surface of the stencil sheet fixing member 3, between the sheet fixing projections 4, there extend in the circumferential direction thereof a plurality of stencil removal grooves 9.

Figure 3:
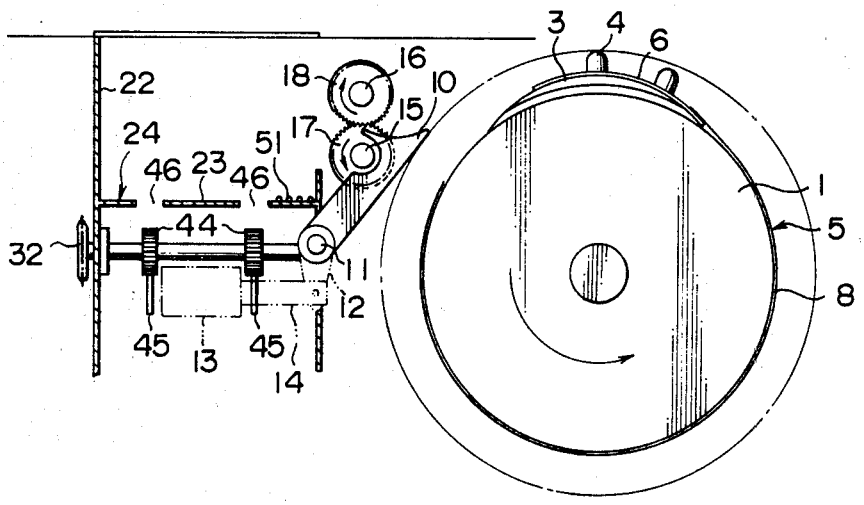
FIG. 3 is a sectional view through the machine shown in FIGS. 1 and 2, taken along the lines III—II, and showing the state of the machine in which a stencil master is mounted to the periphery of the rotary printing drum thereof and is not being removed.

As shown in FIGS. 1 and 3, a stencil sheet 5 is removably fitted around the periphery of the rotary printing stencil drum 1. In the case shown in the figures, in fact, the stencil sheet stencil portion 8 of the stencil sheet 5 is generally quite thin and pliable, and along the left hand edge as seen FIG. 1 of the stencil sheet 5 there extends a stiffer stencil sheet fixing portion 6, which is pierced with a plurality of stencil sheet fixing holes 7, which correspond in position to the drum sheet fixing projections 4 formed on the stencil sheet fixing member 3, and which fit thereover. Thereby, the stencil sheet 5 is detachably attached over the stencil sheet fixing projections 4.

During the printing operation, which will not be specifically described in detail herein because it is not relevant to the gist of the present invention, printing ink is supplied to the radially inner side of the stencil sheet 5 from within the stencil printing drum 1, and this ink passes through perforated holes formed in the stencil sheet 5 to the radially outer side of the stencil sheet 5, wherefrom said printing ink is transferred to paper which is to be printed upon. This printing ink is quite sticky, and accordingly this supply of sticky printing ink to the radially inward side of the stencil sheet 5 causes the stencil sheet 5 to be effectively stuck to the outer periphery of the stencil printing drum 1.

Figure 4:
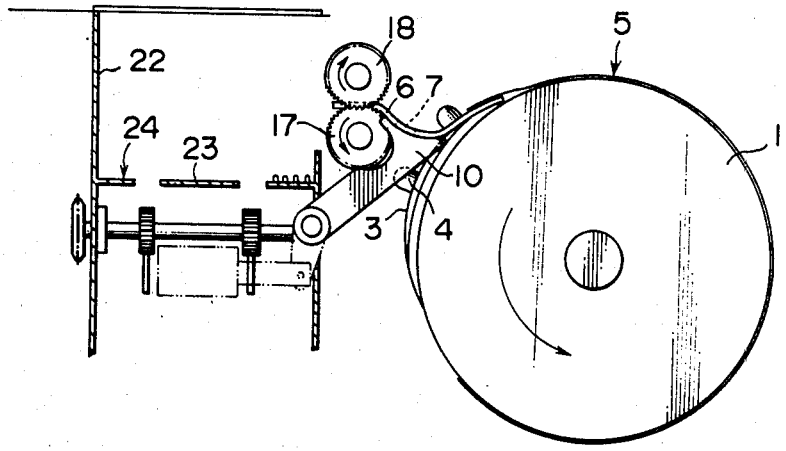
FIG. 4 is a sectional view similar to FIG. 3, showing the machine and the stencil sheet being processed thereby in their conditions wherein the leading edge of said stencil sheet has just been started to be removed from the periphery of said printing drum.

Parallel to the central axis of the rotary stencil printing drum 1 there extends a claw pivot shaft 11, and to this pivot shaft 11 there are fixedly mounted a plurality of guide claws 10, each corresponding to one of the stencil removal grooves 9 formed in the stencil sheet fixing member 3. By rotation to and fro of the claw pivot shaft 11 around its central axis, these guide claws 10 may be rotated so that their free ends approach to and recede from the periphery of the stencil printing drum 1. Further, there is fixedly attached to the claw pivot shaft 11 one end of a claw actuation link 12, the other end of which is pivotally attached to one end of a solenoid armature 14. The solenoid armature 14 extends within a claw actuation solenoid 13, which is fixed to the body of the machine described above by means which are not shown. Further, a biasing means which is not shown biases the solenoid armature 14 to the right in FIG. 3, out from the actuation solenoid 13. Accordingly, by selective energization or de-energization of the solenoid 13, the free end portions of the guide claws 10 may be moved between first positions, as seen in FIG. 3, wherein they are sufficiently far away from the central axis of the rotary stencil printing drum 1 for the drum sheet fixing projections 4 and the stencil sheet 5 to pass by them without being interfered with, and second positions, as shown in FIG. 4, wherein the ends of the guide claws 10 extend into the corresponding stencil removal grooves 9 formed in the stencil sheet fixing member 3, in order to remove the stencil sheet 5 from the stencil printing drum 1 as will hereinafter be described.

A means is provided for feeding the used stencil sheet 5 along a direction substantially parallel to its surface, which will now be described. First and second feed gear wheel support shafts 15 and 16 extend with their axes generally parallel to the central axis of the rotary stencil printing drum 1, as may be seen in FIG. 1, and on these feed gear wheel support shafts 15 and 16 there are respectively fixedly mounted a plurality of stencil feed gear wheels 17 and a plurality of stencil feed gear wheels 18. Each of the stencil feed gear wheels 17 mounted on the support shaft 15 engages with a respective stencil feed gear wheel 18 mounted on the support shaft 16. In the shown embodiment, the feed gear wheel support shaft 15 is selectively rotated in the direction shown by the arrow in FIG. 3 by the driving system 2, via a driven sprocket wheel 19 mounted on the upper end in FIG. 1 of the feed gear wheel support shaft 15, and via an endless drive chain 20. According to this rotation of the shaft 15 and of the stencil feed gear wheels 17 fixedly mounted thereto, the gear wheels 18 are all driven in the rotational direction shown by an arrow in FIG. 3, along with the support shaft 16, by the meshing of the gear wheels 17 with the gear wheels 18. Thus, when the used stencil sheet 5 is inserted in between the stencil feed gear wheels 17 and 18, it is gripped thereby and is fed in the leftwards direction in FIG. 3, as will be more particularly described hereinafter, as well as being peeled away from the surface of the rotary stencil printing drum 1.

The system for prying off the leading edge of a stencil sheet from a rotary stencil printing drum such as the printing drum 1, by the claws such as the claws 10, and for then peeling the stencil sheet progressively away from the periphery of the rotary stencil printing drum through and between gear wheels such as the gear wheels 17 and 18, by the function of these gear wheels of pulling on the part of the stencil sheet 5 which is attached by the viscosity of the printing ink to the surface of the printing drum, has been more particularly described and claimed in the aforementioned Japanese Utility Model Application No. 179596/79.

To the left in FIGS. 1 and 3 of the stencil sheet feeding device comprising the stencil feed gear wheels 17 and 18 there is provided a stencil sheet receiving tray 24, which is generally formed as a groove or gutter shape opening upwardly. In more detail, the bottom of the stencil sheet receiving tray 24 is formed as a support bottom 23 which, as will be described in more detail hereinafter, is perforated with a plurality of longitudinally extending slots 46. Further, in the direction remote from the stencil sheet feeding device comprising the gear wheels 17 and 18, i.e. to the left in FIGS. 1 and 3, this support bottom 23 is bordered by a stop wall 22, which is formed, in this embodiment, of a considerable height, while in the opposite direction, towards the stencil feed gear wheels 17 and 18, the support bottom 23 is bordered by a somewhat lower side wall which itself is not essential for the operation of the present machine. As will be seen in more detail hereinafter, when a stencil sheet 5 is being fed by the stencil sheet feed device comprising the stencil feed gear wheels 17 and 18 in the leftward direction in FIGS. 1 and 3, the leading edge of this stencil sheet 5 comes into contact with the stop wall 22, and thereafter, as the stencil sheet feed mechanism continues to feed the stencil sheet 5 leftwards in FIGS. 1 and 3, the stencil sheet 5 is deposited within the stencil receiving tray 24 in a generally folded up form.

Figure 2:
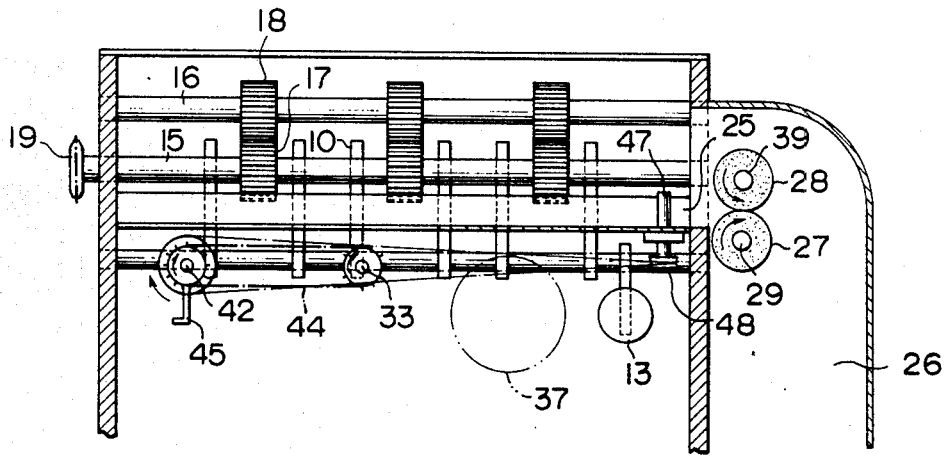
FIG. 2 is a sectional view taken through the machine shown in FIG. 1 along the lines II—II.

Referring generally now to FIG. 2, to the right hand end of the stencil receiving tray 24 there is connected a stencil disposal passage 26 which extends generally downward therefrom, and at the lower extremity (which is not shown in the drawings) of this stencil disposal passage 26 there is provided a receptacle for receiving discarded stencil sheets, such as a box or a bag, with its open end proximate to the lower end of said stencil disposal passage 26.

Below the support bottom 23 of the stencil receiving tray 24 there is provided a system for pushing a folded up stencil sheet to the right in FIG. 2, which will now be described. An electric motor 37 drives a driving sprocket wheel 36, which is connected, via an endless chain 35, to a driven sprocket wheel 34, which is mounted on a first side drive shaft 33. On the first side drive shaft 33 there are fixedly mounted a pair of first side drive pulleys 41. Parallel to the first side drive shaft 33, and to the left thereof in FIG. 2, there is mounted a second side drive shaft 42, on which are fixedly mounted a pair of second side drive pulleys 43. Around each of the first side drive pulleys 41 and its corresponding second side drive pulley 43 there is mounted a claw support chain 44, and these two chains 44 are endless chains. On each of these claw support chains 44 there is mounted a side drive claw 45, each of which therefore moves along with its chain 44. Each of the side drive claws 45 corresponds to one of the slots 46, which as described above are formed in the support bottom 23 of the stencil receiving tray 24; and accordingly, as the first and second side drive pulleys 41 and 43 are rotated and drive the claw support chains 44, the side drive claws 45 are propelled from the left to the right in FIG. 2 while projecting up above the support bottom 23 through their corresponding slots 46, are then rotated downwards around the first side drive shaft 33, are brought back from the right to the left in FIG. 2 while projecting downwards from the support chains 44 below the support bottom 23, and are then brought around the second side drive shaft 42 to again project upwards above the support bottom 23 through their respective slots 46, to then repeat the above described movement.

At the right hand end in FIG. 2 of the stencil receiving tray 24, just at the upper end or start of the stencil disposal passage 26, there is mounted a pinch roller device which will now be described. A lower roller support shaft 29 and an upper roller shaft 39 parallel to said lower roller support shaft 29 extend perpendicularly to the plane of the drawing paper in FIG. 2, in vertical alignment, and on these lower and upper roller support shafts 29 and 39, respectively, there are mounted lower and upper stencil compression rollers 27 and 28. On the right hand ends in FIG. 1 of the lower and upper roller support shafts 29 and 39, respectively, there are mounted a driving gear wheel 38 and a driven gear wheel 40, which accordingly gear together the rotations of the lower and upper stencil compression rollers 27 and 28. The lower roller support shaft 29 which supports the lower stencil compression roller 27 is provided on its left hand end in FIG. 1 with a driven sprocket wheel 30, which is connected, via an endless chain 31, with a driving sprocket wheel 32 which is fixedly mounted on the left hand end in FIG. 1 of the first side drive shaft 33. Accordingly, as the first side drive shaft 33 is rotated in the appropriate rotational direction to move the claws 45 along the slots 46 in the support bottom 23 in the direction, as described above, from the left to the right of FIG. 2, simultaneously the lower and upper stencil compression rollers 27 and 28 are rotated in the directions shown by rotational arrows in FIG. 2. In this particular embodiment, the lower stencil compression roller 27 is formed to have a large number of fine projections defined by a large number of mutually crossing two groups of parallel grooves, and the upper stencil compression rollers 28 is constructed as a corrugated roller.

The selective driving of the driving system 2, and the selective energization of the electric motor 37, are provided via a control system not shown in the figures.

Along the side of the support bottom 23 of the stencil receiving tray 24 which is closest to the stencil sheet feeding mechanism which incorporates the stencil feed gear wheels 17 and 18, etc., there are provided a plurality of groups of protuberances 51, each of which protuberances 51 extends upwards in a dome shape from the plane defined by the upper surface of said stencil receiving tray 24. The function of these protuberances 51 will also be explained hereinafter.

At the lower right corner of the support bottom 23 of the stencil receiving tray 24 as seen in FIG. 1, i.e. at the end of said stencil receiving tray 24 closest to the pinch roller device comprising the lower and upper stencil compression rollers 27 and 28 and on the side of said end remote from the stop wall 22, there is provided as vertically extending perpendicular to the plane of said support bottom 23 a cylindrical pin 47, which is rotated in the counterclockwise direction as seen in FIG. 1 by means of a driven pulley 48 mounted on the lower end of this cylindrical pin 47, said driven pulley 48 being driven by a drive belt 49 which extends from a driving pulley 50 which is fixedly mounted upon the second side drive shaft 42. The function of this rotating cylindrical pin 47 will also be explained hereinafter.

The device described above operates as follows.

Starting from the condition of the apparatus shown in FIGS. 1–3, in which the stencil sheet 5 is wrapped around the outer periphery of the rotary stencil printing drum 1 and is held thereto by the stickiness of the printing ink supplied as explained above therebetween, when it is decided by the operator of the machine that the stencil sheet 5 should be removed from the rotary printing drum 1 and should be disposed of, then a stencil sheet removal instruction is given to the machine, at a control panel thereof, of a control system thereof, neither of which are shown in the figures. According to this instruction, the claw actuation solenoid 13 is supplied with actuating electrical energy, and accordingly this solenoid 13 attracts the armature 14, and, via the claw actuation link 12, turns the pivot shaft 11 clockwise in FIG. 3, so as to move the free ends of the guide claws 10 towards the central axis of the rotary stencil printing drum, i.e. to their positions as seen in FIG. 4, wherein these free claw ends are engaged into the stencil removal grooves 9 formed in the stencil sheet fixing member 3, when of course said stencil sheet fixing member 3 is at an appropriate rotational position around the central axis of the printing drum 1.

At the same time, the printing drum 1 is rotated, and also the stencil feed gear wheels 17 and 18 are rotated in the rotational directions shown in FIG. 4. Accordingly, as may be seen in FIG. 4, the ends of the guide claws 10 pass underneath the stiffer stencil sheet fixing portion 6 of the stencil sheet 5, this fixing portion 6 being as explained above engaged over the sheet fixing projections 4 by the fixing holes 7 formed in said fixing portion 6. By the rotation of the printing drum 1, this stencil sheet fixing portion 6 is pried off from the fixing projections 4, and is guided over the curved surfaces of the free ends of the guide claws 10 so as to be inserted between the stencil feed gear wheels 17 and 18. FIG. 4 shows the position of the apparatus in which the leading edge of the stencil sheet portion 6 has just passed between the gear wheels 17 and 18.

After the leading edge of the stencil sheet fixing portion 6 has entered between the stencil feed gear wheels 17 and 18, then the pinch roller action of these gear wheels 17 and 18 takes over the function of transporting the stencil sheet 5, and the stencil sheet stencil portion 8 of the stencil sheet 5 is progressively peeled off from the surface of the printing drum 1 by the pulling off action of the gear wheels 17 and 18, which transport the stencil sheet 5 as a whole in a direction parallel to its surface along a line which is tangential to the surface of said rotary stencil printing drum 1. An intermediate stage in this process may be seen in FIG. 5. As can easily be understood, this peeling off action for the stencil sheet 5 continues until the trailing edge of the stencil sheet stencil portion 8 passes through and between the stencil feed gear wheels 17 and 18 and is released thereby.

After the stencil sheet fixing member 3 has been rotated by the rotation of the stencil printing drum 1 past the rotational position in which the ends of the guide claws 10 come out of the trailing ends of the stencil removal grooves 9, then the claw actuation solenoid 13 may be de-energized, and accordingly the guide claws 10 are brought back to their original retracted positions as seen in FIG. 3.

This peeling off action for removing a used stencil sheet from the periphery of the rotary stencil printing drum 1 has been explained, and claimed, in the aforementioned Japanese Utility Model Application, and is only relevant to the gist of the present invention by way of background.

The stencil sheet 5 is, as explained above, fed in the leftwards direction in FIGS. 4 and 5 parallel to the plane of its surface, and the disposal process thereof, which is a preferred embodiment of the process according to the present invention, will now be explained.

Figure 5:
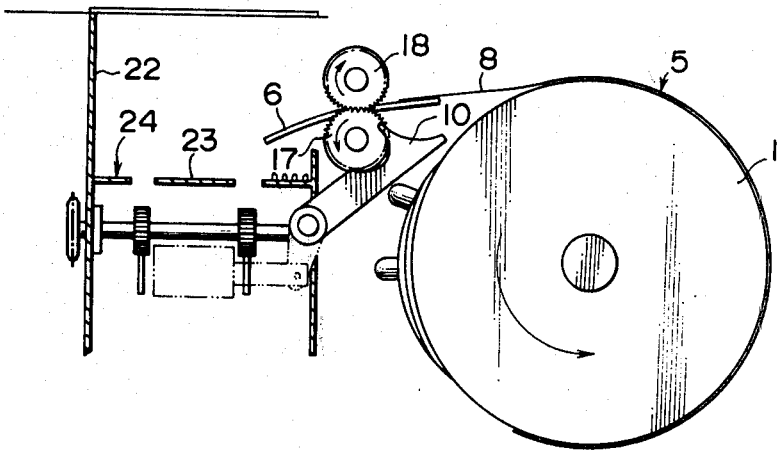
FIG. 5 is a sectional view, similar to FIGS. 3 and 4, showing the machine and the stencil sheet in their conditions in which the removal of the stencil sheet from the periphery of the printing drum has progressed somewhat from the position shown in FIG. 4.

The leading edge of the stencil sheet fixing portion 6, during this feeding process, i.e. the left hand end of the section thereof which is shown in FIGS. 4 and 5, is displaced leftwards in FIGS. 4 and 5 until it comes into contact with the stop wall 22 of the stencil receiving tray 24. After the leading edge of the stencil sheet fixing portion 6 has abutted against the stop wall 22, by the continued feeding action provided by the stencil feed gear wheels 17 and 18, which continue to feed the stencil sheet stencil portion 8 of the stencil sheet 5 leftwards in FIGS. 4 and 5, the stencil sheet stencil portion 8 is folded up into a stacked form in the stencil receiving tray 24, as may be seen in cross section in FIG. 7 and in side view in FIG. 6. That is to say, the stencil sheet 5 is folded up into a plurality of layers, denoted in FIG. 7 by 8*a*, 8*b*, and 8*c* superposed in the vertical direction, said layers resting on the support bottom 23 of the stencil receiving tray 24. As a matter of fact, in the shown embodiment of the process and the machine according to the present invention, this smooth process of folding and stacking is substantially facilitated by the described construction of the stencil sheet 5 as composed of a stiff leading stencil sheet fixing portion 6 and a much more floppy trailing stencil sheet stencil portion 8.

Figure 6:
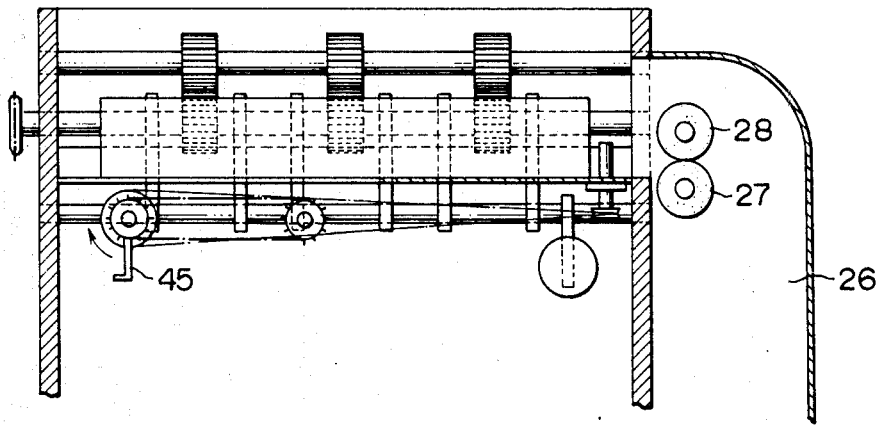
FIG. 6 is a sectional view, similar to FIG. 2, showing the stencil sheet, which has been removed from the periphery of the printing drum, in a folded up form and held on a stencil sheet receiving tray of the machine.

When it is determined that the stencil sheet 5 has been completely removed from the outer periphery of the rotary stencil printing drum 1, and has been completely folded up into layers in this manner within the stencil receiving tray 24, which can be determined, for example, from the rotational position of the rotary printing drum 1, then at this time actuating electrical energy is supplied by the abovementioned control system to the electric motor 37. Accordingly, the first and second side drive shafts 33 and 42, and the first and second side drive pulleys 41 and 43 respectively fixedly mounted thereon, along with the associated claw support chains 44 and the side drive claws 45 mounted thereon, start to rotate, and also the lower and upper stencil compression rollers 27 and 28 start to rotate, as does the cylindrical pin 47. Referring now to FIG. 6, the side drive claws 45 are brought as shown by the rotational arrow around the second side drive pulleys 43, and as shown in FIG. 8 are then engaged with the left hand end in FIGS. 6 and 8 of the folded up stencil sheet 5, as said stencil sheet 5 lies on the support bottom 23 of the stencil receiving tray 24 in the form of the above mentioned superposed layers; this position of the claws 45 and of the folded up stencil sheet 5 is shown by the solid lines in FIG. 8.

Figure 8:
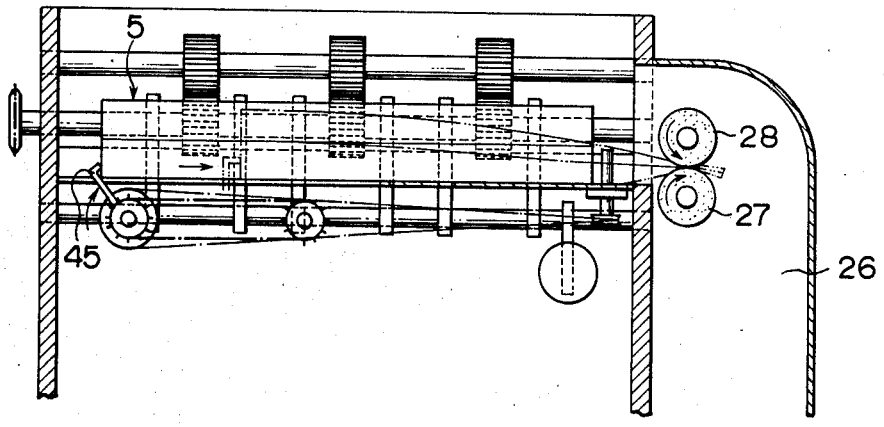
FIG. 8 is a sectional view, similar to FIGS. 2 and 6, showing in solid lines the position of the folded up stencil sheet within the above mentioned receiving tray when said stencil sheet is just commencing to be pushed sideways off from said tray, and showing in phantom lines the position of said stencil sheet after the leading edge of said stencil sheet has just entered between a pair of rollers which are in process of ejecting said stencil sheet into a disposal passage.

According to further rotation of the first and second side drive pulleys 41 and 43, etc., which is provided by the electric motor 37, the side drive claws 45 are moved rightwards in FIG. 8, pushing the folded up stencil sheet 5 to the right in FIG. 8, and the right hand end of the folded up stencil sheet 5 then enters between the counter rotating lower and upper stencil compression rollers 27 and 28, which then grip this end portion of the stencil sheet 5 and take said end portion in between themselves; this position is shown by a dot dot dash line in FIG. 8. It is arranged that the peripheral speed of the surfaces of the lower and upper stencil compression rollers 27 and 28 provided by their rotation is greater than the speed of movement of the claws 45 rightwards in FIG. 8, so that, after the position shown in FIG. 8, the stencil sheet 5 folded up into the above mentioned superposed layers is pulled to the right in the figure more quickly than the claws 45 are moving to the right, and accordingly the left hand end of the folded up stencil sheet 5 is progressively pulled away from the claws 45, leaving the claws 45 behind. Thus, the lower and upper stencil compression rollers 27 and 28 take over the function of transporting the folded up stencil sheet 5 from the claws 45, and thereafter, as seen in FIG. 9, the claws 45 pass around the circumferences of the first side drive pulleys 41, so as to be withdrawn from the slots 46 and so as to be returned again under the stencil receiving tray 24 towards the left hand end of their travel.

Figure 9:
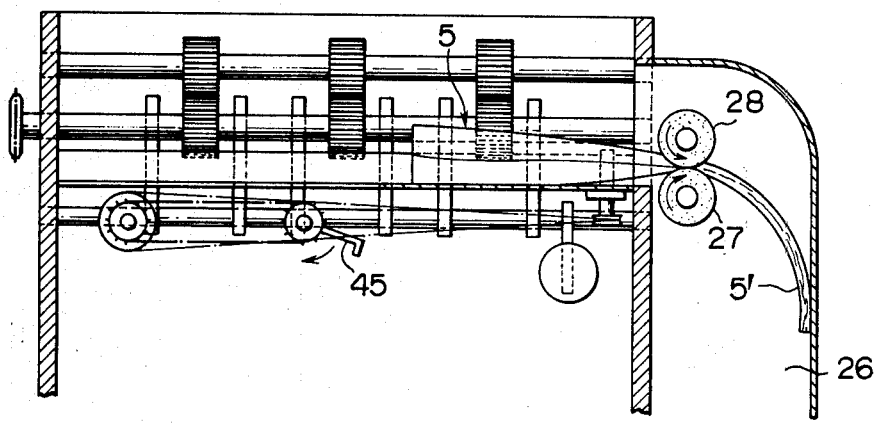
FIG. 9 is a sectional view, similar to FIGS. 2, 6, and 8, showing said used stencil sheet in the position where it has progressed between said rollers for approximately half its length, and is being ejected into said disposal passage.

Meanwhile, as seen in FIG. 9, progressively the stencil sheet 5 is being compressed together by the lower and upper stencil compression rollers 27 and 28 as it is being moved to the right. Because the stencil sheet 5 is sticky, due to the residual printing ink remaining thereon, its superposed layers are crushed together by the above mentioned compression effect provided by the rollers 27 and 28, and this rolling and crushing process continues beyond the state shown in FIG. 9, until the left hand end as seen in FIG. 9 of the stencil sheet 5 passes between the rollers 27 and 28, and then the compacted stencil sheet 5, folded into a plurality of compacted superposed layers which have been crushed together, is released from between the stencil sheet compression rollers 27 and 28, so that the stencil sheet 5 drops down through the stencil disposal passage 26 into the receptacle such as a box or bag provided at the lower end of said stencil disposal passage 26 as explained above.

Because the stencil sheet 5 which is to be discarded has been folded up as described above into a plurality of superposed layers which have been crushed together, accordingly the discarded form of the stencil sheet 5 is relatively narrow, and thus the stencil sheet 5, when discarded, occupies far less room in the disposal receptacle such as a box or bag than would be the case if it were not folded up and crushed. Thus, a higher density for disposal of the used stencil sheets can be attained.

Thus, it is seen that the process of disposing of a sticky sheet explained above according to the preferred embodiment of the process and machine according to the present invention is quick and automatic, and accordingly presents no risk of soiling an operator, or the clothes of an operator. Further, because the sticky sheet, which in the shown embodiment is a used stencil sheet sticky with stencil printing ink, is disposed of in a folded up form, as a matter of course it will be less sticky than if it were not folded up. This enhances disposability.

Figure 7:
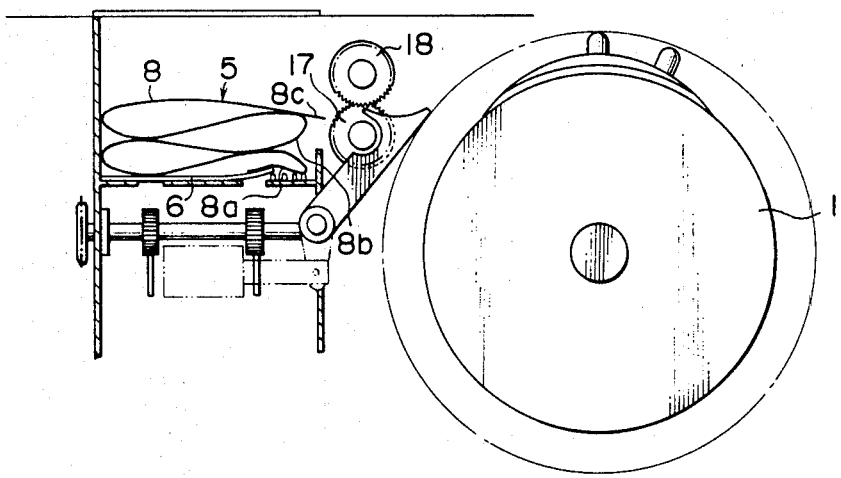
FIG. 7 is a sectional view, similar to FIGS. 3, 4, and 5, also showing the stencil sheet lying within the above mentioned receiving tray in a folded up form which is composed of superposed layers.

During this process, from the stage shown in FIG. 8 by solid lines wherein the claws 45 have just engaged with the left hand end in the figure of the stencil sheet 5 as folded up in a plurality of superposed layers, through the state shown in FIG. 9, to ultimate dropping of the folded and crushed stencil sheet 5 into the disposal passage 26, the operation of the rotating cylindrical pin 47 by rotating in the counterclockwise rotational direction as seen in FIG. 1 is very helpful for guiding the right hand edge as seen in FIG. 7 of the folded up superposition of the stencil sheet layers so that the folded up stencil sheet 5 is properly guided between the lower and upper stencil compression rollers 27 and 28, without interfering with or fouling other parts of the machine. This effect is produced because the outer periphery of the rotating cylindrical pin 47 is rotating in the direction which urges said right hand edge of the folded up stencil sheet 5 towards the moving means comprising the stencil compression rollers 27 and 28.

Further, during the process of movement of the folded up stencil sheet to the right in FIGS. 8 and 9 by the lower and upper stencil compression rollers 27 and 28, the plurality of groups of protuberances 51, which project upwards from the plane of the upper surface of the support bottom 23 of the stencil receiving tray 24, function to reduce the frictional effect between the lowest layer 8*a* of the folded up superposed layers of the stencil sheet 5 and said upper surface of the support bottom 23. The stickiness of the printing ink which remains on the lower surface of the lowest layer 8*a* of the folded up stencil sheet 5 causes considerable friction of the lowest layer 8*a* of the folded up stencil sheet 5 against the support bottom 23 of the stencil receiving tray 24, and this friction can cause difficulties in the smooth and effective movement of the folded up stencil sheet 5 to the right in FIGS. 8 and 9. Thus the provision of these protuberances 51 on the support bottom 23 of the tray 24 very considerably alleviates this problem of high friction due to stickiness. Thereby, deterioration in the folded up shape of the stencil sheet 5, during movement of the stencil sheet 5 to the right in FIGS. 8 and 9, is effectively avoided.

Although the present invention has been shown and described in terms of a preferred embodiment thereof, and with reference to the accompanying drawings, none of these should be considered as limitative of the present invention; various alterations, modifications, and omissions to the form of any particular embodiment of the present invention would be possible, without departing from its scope.

We claim:

1. A process for disposing of a sticky sheet, comprising the steps of:

(a) feeding said sticky sheet in a first direction substantially parallel to its surface so that the leading edge of said sticky sheet in said first direction is abutted against a stopper construction; subsequently (b) further feeding said sticky sheet in said first direction so that said sticky sheet is folded up into a plurality of layers superposed in a second direction substantially perpendicular to the surface of said sticky sheet during the abovementioned feeding step, said layers then resting upon a support construction which extends from the lower part of said stopper construction in the direction opposite to said first direction; and subsequently (c) moving said sticky sheet in a third direction substantially perpendicular to said first and second direction so as to dispose of said sticky sheet, while compressing together said superposed layers in said second direction so as to stick together said superposed layers.

2. A process for disposing of a sticky sheet according to claim 1, wherein said compression together of said superposed layers of said sticky sheet is a rolling together which is performed by passing said superposed layers between a first roller and a second roller parallel to said first roller, and by crushing said superposed layers between said first and said second rollers, while said superposed layers are moved in said third direction by said first and second rollers.

3. A process for disposing of a sticky sheet according to claim 1 or 2, wherein said sticky sheet is a used stencil sheet having an ink layer on one surface thereof.

4. A machine for disposing of a sticky sheet, comprising:

(a) a means for feeding said sticky sheet in a first direction substantially parallel to the surface of said sticky sheet;

(b) a stopper construction, located in a position so that the leading edge of said sticky sheet, as said sticky sheet is moved in said first direction by said feeding means, is abutted against said stopper construction and is stopped thereby;

(c) a plane support construction, which extends from the lower part of said stopper construction in the direction opposite to said first direction, so that, as said sticky sheet is further fed in said first direction by said feeding means after the leading edge of said sticky sheet has abutted against said stopper construction, said sticky sheet is folded up into a plurality of layers superposed on one another in a second direction substantially perpendicular to the surface of said plane support construction while said sticky sheet is being fed by said feeding means, said superposed layers resting on said plane support construction; and (d) a means for moving said sticky sheet, which, after said sticky sheet has been folded into said plurality of superposed layers resting on said plane support construction, moves said sticky sheet in a third direction substantially perpendicular to said first and second directions so as to dispose of said sticky sheet, while it compresses together said superposed layers in said second direction so as to stick together said superposed layers.

5. A machine for disposing of a sticky sheet according to claim 4, wherein said moving means comprises:

(e) a first rotating roller and a second rotating roller parallel to said first rotating roller, the leading edge of said sticky sheet in said third direction, after said sticky sheet has been folded into said plurality of superposed layers and while said sticky sheet is resting upon said plane support construction, being introduced between said first roller and said second roller so that said first roller and said second roller compress together said superposed layers, and so that said first roller and said second roller by their rotation pull said superposed layers through between them in said third direction so as to eject said compressed together superposed layers on the side of said first and said second rollers in said third direction so as to be disposed of; and (f) a means for pushing the trailing edge of said sticky sheet, after said sticky sheet has been folded into said plurality of superposed layers and while said sticky sheet is resting on said plane support construction, in said third direction, so as to introduce the leading edge of said folded up sticky sheet between said first roller and said second roller.

6. A machine for disposing of a sticky sheet according to claim 5, wherein said pushing means comprises an endless chain extended below said plane support construction and a push member supported on said endless chain, said plane support construction being formed with a slit along which said push member passes as said endless chain is selectively rotated, said push member then pushing against the trailing edge of said sticky sheet in said folded up layered form so as to impel said sticky sheet in said third direction, said push member continuing to be projected from said slit as said claw moves along said slit.

7. A machine for disposing of a sticky sheet according to any one of claims 4, 5, or 6, further comprising a cylindrical pin which extends from said plane support construction substantially in said second direction, said cylindrical pin, when said moving means is moving said sticky sheet in said folded layered form in said third direction, engaging with an edge of said folded layered sticky sheet which extends generally along said third direction, said pin being at this time rotated in such a rotational direction as to further urge said sticky sheet in said third direction.

8. A machine for disposing of a sticky sheet according to any one of claims 4, 5, or 6, wherein the upper surface of said plane support construction is formed with a plurality of projections which support said sticky sheet in said folded up layered form; whereby the frictional resistance between said sticky sheet in said folded up layered form and said support construction may be minimized, while said moving means moves said sticky sheet in said third direction.

9. A machine for disposing of a sticky sheet according to any one of claims 4, 5, or 6, wherein said machine is incorporated in a stencil duplicator, and said sticky sheet is a stencil sheet which has been used in and is to be disposed of from said stencil duplicator.

* * * * *